United States Patent [19]

Olson

[11] 4,444,088

[45] Apr. 24, 1984

[54] AUTO-FIRE ASSEMBLY FOR INDUSTRIAL SHOTGUN

[75] Inventor: Richard H. Olson, Florissant, Mo.

[73] Assignee: Olin Corporation, Stamford, Conn.

[21] Appl. No.: 356,063

[22] Filed: Mar. 8, 1982

[51] Int. Cl.[3] ..... F41F 11/00; F41F 11/075; F41F 1/00

[52] U.S. Cl. ..... 89/25; 42/28; 89/1 R; 89/27 F

[58] Field of Search ..... 89/24, 25, 27 R, 27 D, 89/27 F, 151, 1 R; 42/28

[56] References Cited

U.S. PATENT DOCUMENTS

| | | | |
|---|---|---|---|
| 2,415,952 | 2/1947 | Loomis | 89/24 |
| 2,606,384 | 8/1952 | Perry | 42/28 |
| 2,977,855 | 4/1961 | Catlin et al. | 89/27 R |
| 3,763,742 | 10/1973 | Kotas et al. | 89/24 |
| 4,341,031 | 7/1982 | Palmer et al. | 89/24 X |

*Primary Examiner*—Donald G. Kelly
*Attorney, Agent, or Firm*—Bruce E. Burdick

[57] ABSTRACT

An improved auto-fire assembly for an industrial gun of 8 gauge or larger which releases the trigger of the gun in response to the breech block of the gun being fully placed in closed breeching position.

The mechanism presented provides a trip arm to be contacted by the industrial gun operating lever, with the trip arm on a shaft rotatably mounted on the stop bracket limiting breech opening. The resultant simplified structure enables easy modification of existing lanyard operated guns to include autofire capability.

1 Claim, 5 Drawing Figures

AUTO-FIRE ASSEMBLY FOR INDUSTRIAL SHOTGUN

BACKGROUND AND SUMMARY OF INVENTION

Figure 1:
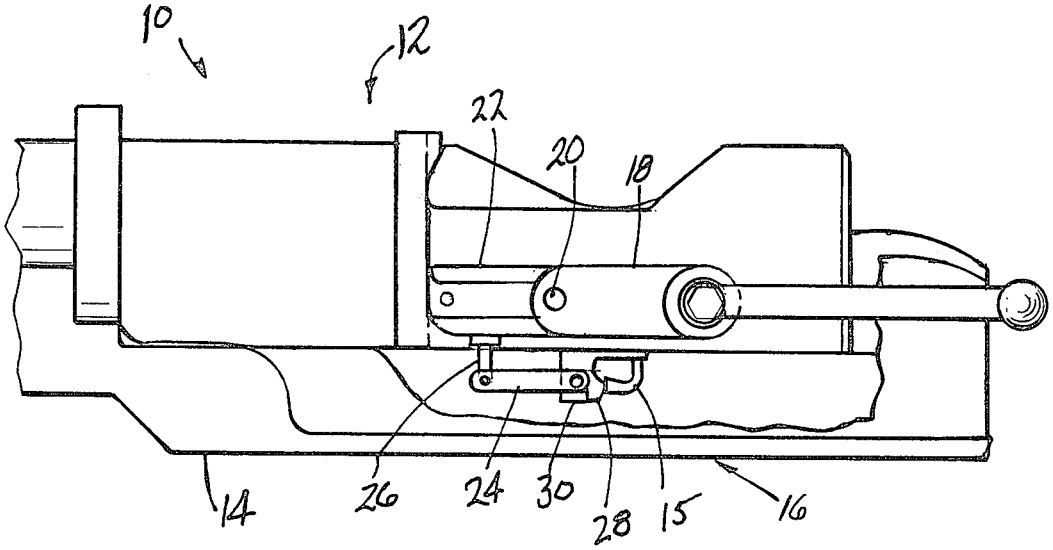

Industrial guns have found increasing use in situations where it is necessary or desirable to dislodge equipment obstructions at fairly large distances from the interiors of heated equipment where it would be unsafe for humans to enter into the equipment to dislodge the obstructions. For example, industrial 8 gauge guns are currently used to dislodge rings or residue which form in kilns rather than have to allow the kiln to cool off so that personnel can enter the interior of the kiln to dislodge these rings. In this way, the kiln can be kept at an elevated temperature to avoid reheating expenses and time and the rings can be dislodged by shooting them off, piece by piece, with gun projectiles. In most cases, cylindrical-shaped projectiles fired one at a time are used rather than multiple projectiles or shot. These industrial guns using 8 gauge or larger cartridges produce such large recoil that they are not handheld but rather are conventionally mounted on stands adjacent the opening of the kiln. From this position they are fired into the kiln to dislodge the obstructions. It may take literally thousands of rounds to ultimately dislodge the entire obstruction. The conventional industrial gun has a lever actuated dropping breech block and a lanyard operated trigger. This requires two people for fast operation since two hands are needed to operate the breech block lever and the lanyard leaving no hands to load the shells into the gun. In order to allow single personnel operation some industrial guns have an auto-fire mechanism which automatically fires the gun when the breech block is raised to the fully upright closed breeching position. However, the number of existing lanyard operated industrial guns is such that it is desirable to design the auto-fire gun with parts that are readily interchangeable with those in the lanyard operated gun so that conversion of guns from auto-fire to lanyard operation or from lanyard operation to auto-fire operation can be rapidly accomplished. One conventional auto-fire assembly (used prior to the subject of this patent) requires substantially a complete disassembly of the lanyard operated gun in order to insert the several components of the auto-fire assembly and convert the gun to auto-fire. There is a need for an auto-fire assembly which can be more rapidly installed in lanyard operated guns in order to minimize the changeover time from lanyard operation to auto-fire operation.

The present invention solves this problem by providing a trip arm actuated by the lever which operates the breech block, the trip arm being in turn connected by a fixed-axis shaft to a trigger actuator which pushes the trigger in response to the trip arm being depressed. Thus, when the trip arm is depressed the gun fires if the trigger is in a position adjacent to the trigger actuator. The trigger actuator is located on the gun in such a position that the trigger lies adjacent to the trigger actuator only when the breech block is in its fully upright closed breeching position in order to prevent firing of the gun when the breech block is not in that position.

Figure 2:
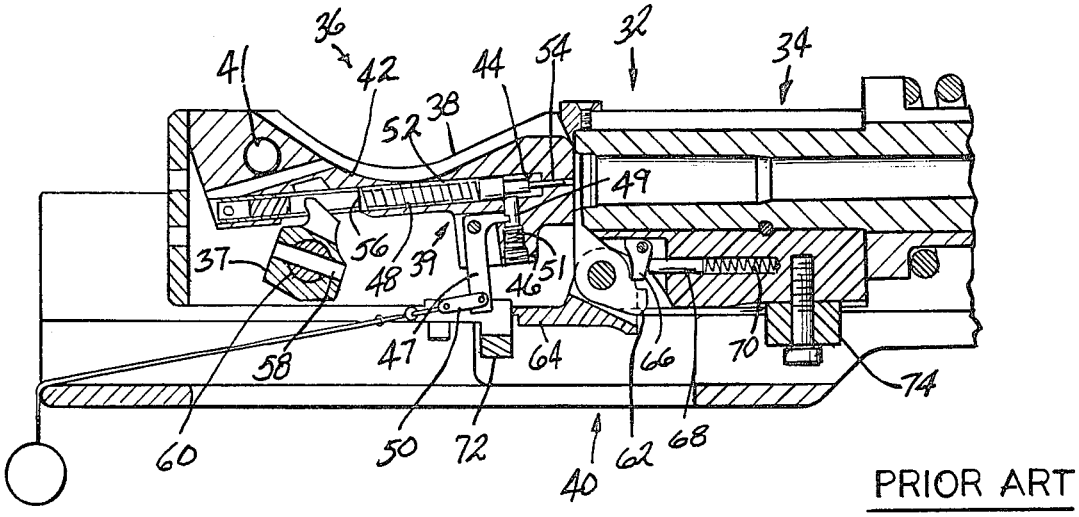
Figure 3:
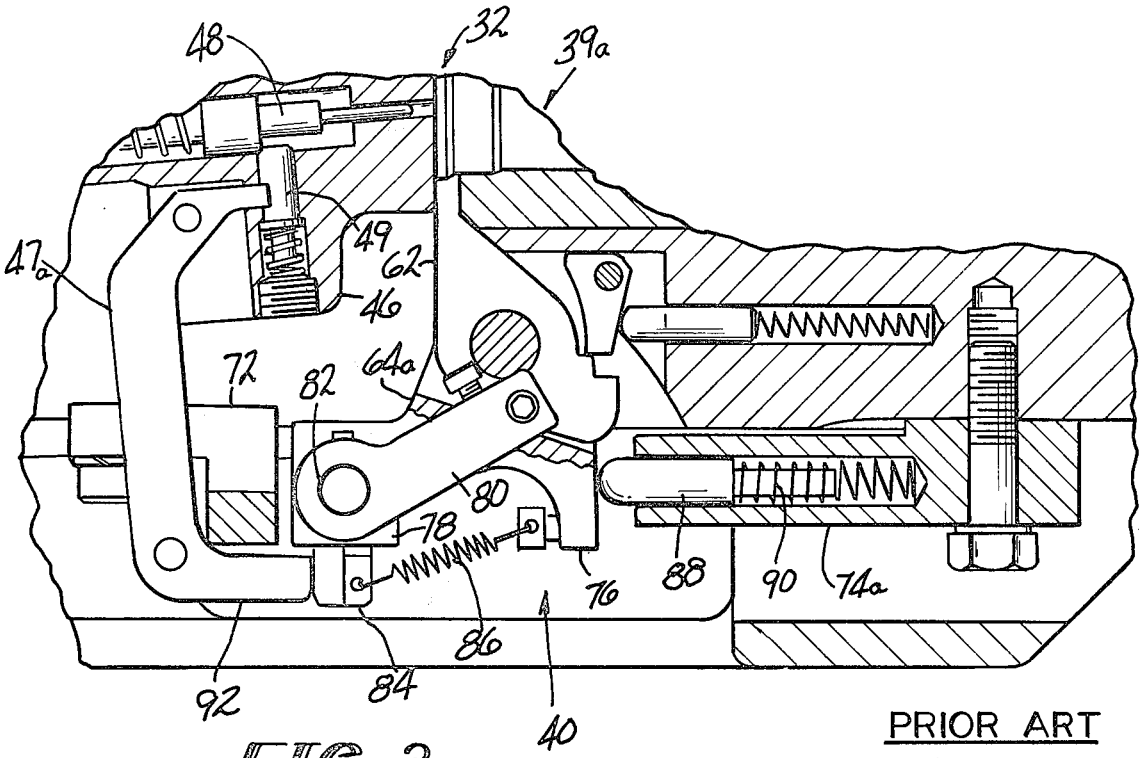
PRIOR ART FIG-3
Figure 4:
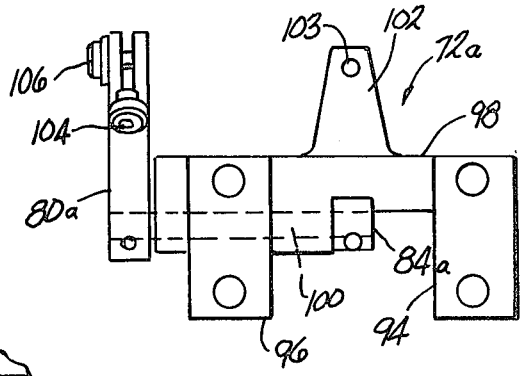
Figure 5:
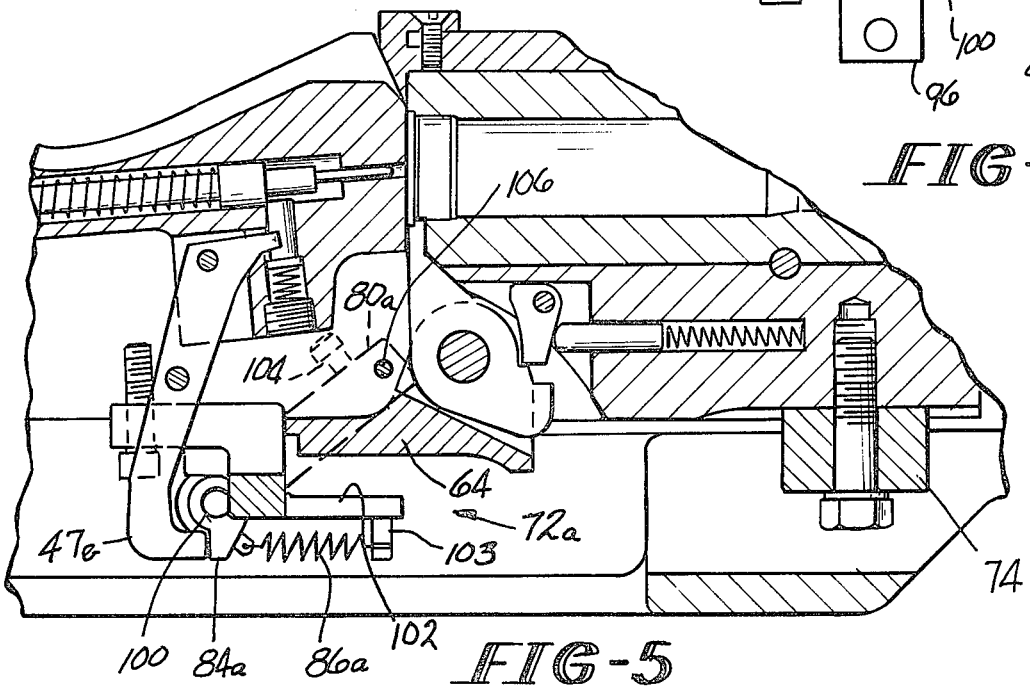

The invention will be better understood by reference to the attached drawings in which:

FIG. 1 is a left elevational side view of an industrial gun embodying the invention, FIG. 2 is a vertical cross-sectional view through the receiver of a prior art lanyard operated industrial gun, FIG. 3 is a partial vertical cross-sectional view through the center of the receiver of a prior art auto-fire industrial gun, FIG. 4 is a top view of an auto-fire assembly embodying the invention, and FIG. 5 is a partial vertical cross-sectional view through the center of the receiver of an auto fire industrial gun embodying the invention.

Referring to FIG. 1, industrial gun 10 assembly comprises an industrial gun 12 and a gun mount 14. Gun 12 is slideably mounted atop mount 14 in order to allow gun 12 to slide rearwardly during recoil. Gun 12 includes a trigger 15 which is actuated by an auto-fire mechanism 16 which is, in turn, actuated by camming lever 22 attached to the side of gun 22. Camming lever 22 is rotated during operation by rotation of handle 19. Rotation of handle 19 rotates cocking link 18 and its associated pin 20 which, in turn, engages and rotates camming lever 22. Handle 19, link 18, and lever 22 all are attached to and rotate with a common shaft (such as shaft 60 of FIG. 2). When handle 19 is raised upwardly to the position shown in FIG. 1, cocking link 18 and pin 20 move downwardly thereby moving camming lever 22 downwardly to depress a trip arm 24 of auto-fire mechanism 16. Auto-fire mechanism 16 includes this trip arm 24, a trip arm adjustment screw 26, a trigger actuator 28 and an auto-fire bracket 30. Bracket 30 is mounted on the bottom of the receiver of gun 12 and supports both trip arm 24 and trigger actuator 28 as well as a shaft connecting arm 24 to actuator 28.

To better appreciate the nature of the invention two prior art figures are included to show the two previous versions of the industrial gun. FIG. 2 shows the operational parts of a lanyard operated industrial gun. In the lanyard operated gun, a receiver 32 is provided comprising a barrel assembly 34 and a breech block assembly 36. Breech block assembly 36 includes a cocking cam 37, a breech block 38, a firing mechanism 39 and an extraction mechanism 40. Block 38 further comprises a pivot pin 41, a loading ramp 42, a bore 44 and a foot portion 46. The forward end of block 38 is shown in the fully upright closed breeching position in which block 38 is aligned with the chamber bore of barrel assembly 34 so that the cartridges can be fired by actuation of firing mechanism 39. Block 38 can rotate downwardly from the position shown to a second position in which the bottom of foot portion 46 rests against the top of a stop bracket 72 attached to the bottom of receiver 32. In this second downward position, loading ramp 42 is aligned with the bottom of the chamber bore of barrel assembly 34 so that a cartridge can be placed on ramp 42 and slid into the chamber bore for later firing. Breech block 38 is rotated between these two positions by rotation of cocking cam 37. It will be seen that when cocking cam 37 is rotated counterclockwise it presses rearwardly against the lower portion of block 38 thus rotating block 38 downwardly in a clockwise direction until foot portion 46 contacts the stop bracket 72, as mentioned above. One of the portions of block 38 which is contacted by cocking cam 37 is a cam slot 56 of the firing pin 48 of the firing mechanism 49. Thus any time the gun is being cocked by moving the firing pin to the rear, the breech block is lowered out of the upright position and into its downwardly position. The cocking cam must subsequently be returned to its original position in order to move the breech block back to its upright position in order to allow the gun to be fired. Firing mechanism 39 comprises a trigger 47, a firing pin 48, a sear 49, a pull chain or lanyard 50, a sear spring 51 and a firing spring 52. Firing pin 48 lies within bore 44 of block 38 and has a tip 54 extending through the breech face or forward end of block 38 into a position substantially centered with the breech end of the barrel of the gun. As lanyard 50 is pulled downward it is evident that trigger 47 will be rotated clockwise and pull sear 49 downwardly to release firing pin 48 under the bias of firing spring 52. When lanyard 50 is released sear spring 51 will push sear 49 back into a position locking firing pin 48 as soon as firing pin 48 is moved rearwardly during the cocking procedure. Cocking cam 37 is held onto a cam shaft 60 by a cam pin 58. Cam shaft 60 extends through the side of receiver 32 and receives the camming lever 22 (see FIG. 1). Thus when handle 19 is rotated camming lever 22 is rotated and cocking cam 37 is rotated.

The extraction mechanism of receiver 32 includes an extractor 62, an extractor release cam 64; an extractor release 66, a release plunger 68 and a release plunger spring 70. Extractor 62 forms the lower part of the breech end of barrel assembly 34 and thus engages the rim of any shell placed within the chamber of barrel assembly 34. Extractor 62 is biased (by springs not shown) to rotate in the counterclockwise direction but is restrained by extractor release 66 which is held against a notch in extractor 62 by a release plunger 68 and release plunger spring 70. In order to release extractor 62 extractor release cam 64 is provided which is depressed by lower right-hand corner of breech block 38 when block 38 is rotated downwardly. Specifically, release cam 64 is rotated counterclockwise and lifts extractor release 66 out of the notch of extractor 62 thereby releasing extractor 62 which in turn extracts the shell from the chamber of barrel assembly 34. When block 38 is returned to the position shown in FIG. 2 the release cam 64 returns clockwise to its pictured position under the influence of a return spring and plunger (not shown).

It is apparent that this mechanism is sufficiently simple that it can be used many many times without any need for maintenance or repair, although periodic cleaning will be necessary. It will also be apparent that two people are required for operation since one operator must use both hands if he is to operate the gun in a fast manner. A fast manner of operation would require one hand on the handle 19 and the other hand on lanyard 50 so that one hand could be used to lower the breech block and cock the gun with operating handle 19 while the other would be used to fire the gun by pulling lanyard 50. A second person would be necessary to load the shells into the gun chamber to avoid the first operator having to let go of either the lanyard or handle. In order to overcome the need for a second operator, the auto-fire mechanism of FIG. 3 was previously developed. The auto-fire assembly of FIG. 3 is similar to the lanyard operated mechanism of FIG. 2 except that the lanyard is omitted and an auto-fire assembly is added. Referring to FIG. 3, receiver **32*a* includes a firing mechanism 39*a* which is identical to that of FIG. 2 except that a modified trigger 47*a* is used instead of trigger 47. In addition, a modified extractor release cam 64*a* is substituted for extractor release cam 64. Modified cam 64*a* includes two projections 76 and 78. A trip arm 80, shaft 82 and trigger actuator 84 are mounted on projection 78 and an auto-fire spring 86 is attached between actuator 84 and projection 76 so that trip arm is biased upwardly and trigger actuator 84 is biased away from trigger 47*a*. The mechanism is shown in FIG. 3 in the position it would occupy when breech block 38 is in its fully upright closed breeching position but camming lever 22 has not yet depressed trip arm 80 to fire the gun. In this position, trigger actuator 84 lies against a foot 92 of trigger 47*a*. Foot 92 serves to allow trigger 47*a* to pass around and under stop bracket 72 so that it can be actuated by a trigger actuator 84 mounted on the projection 78 of modified extractor release cam 64*a*. In order to hold extractor release cam 64*a* in position while trip arm 80 is depressed, a modified guide block 74*a* is provided with a plunger 88 and a plunger spring 90. Plunger 88 pushes against the forward side of cam 64*a* and biases cam 64*a* in the clockwise direction. Spring 90 is of sufficient strength to overcome the tendency which would otherwise exist for cam 64*a* to rotate in the counterclockwise direction thereby releasing extractor 62 in a premature manner. The spring return system for cam 64*a* used with the lanyard style gun cannot be used because of interference with trip arm 80. While the mechanism shown in FIG. 3 does provide an auto-fire capability it is clear by reference to FIGS. 2 and 3 taken together with a major disassembly of the internal mechanism of FIG. 2 would be necessary to achieve the mechanism of FIG. 3 since removal of trigger 47, cam 64 and its return spring and plunger, and guide block 74 would require substantially complete disassembly of receiver 32. In order to avoid the need for such complex disassembly both internal to the receiver and external and to reduce the number of parts and simplify the mechanism and make it interchangeable with the mechanism of FIG. 2, the invention of an improved auto-fire assembly was undertaken resulting in an auto-fire assembly such as that shown in FIGS. 4 and 5. The auto-fire assembly comprises a modified stop bracket 72*a* and a modified trigger 47*b*. Modified stop bracket 72*a* and modified trigger 47*b* can be added to the mechanism of FIG. 2 by first removing the existing trigger 47 and existing stop bracket 72 and substituting trigger 47*b* and bracket 72*a*. Bracket 72*a* with its assembled components quickly bolts to the underside of the receiver without disturbing internal shell ejection hardware. Bracket 72*a* comprises two mounting flanges 94 and 96, a cross member 98, a shaft 100, a spring mount 102, a spring mount pin 103, a spring 86*a*, an adjustment screw 104, a lock screw 106, a trip arm 80*a* and a trigger actuator 84*a*. Flanges 94 and 96 and cross member 98 occupy substantially the same space as would have been previously occupied by conventional stop bracket 72. However, cross member 98 is extended rearwardly and contains a rotatable shaft 100 similar to shaft 82 of FIG. 3. On opposite ends of shaft 100 are mounted trip arm 80*a* and trigger actuator 84*a* so that when trip arm 80*a* is rotated downwardly, trigger actuator 84*a* is moved rearwardly to push trigger 47*b* and fire the gun. A spring 86*a* is attached between trigger actuator 84*a* and spring mount pin 103 attached to spring mount 102. This configuration allows for use of the slide block 74 of FIG. 2 and the unmodified extractor mechanism of FIG. 2. The revised auto-fire mechanism of FIG. 4 thus eliminates the need for special guide block 74*a*, plunger 88, plunger spring 90 and modified extractor release cam 64*a*** with its associated parts.

I claim:

1. In a breech loaded industrial gun of the type having a firing pin, a breech block with the front of the block being vertically rotatable about a pin at the rear of the block between a first upper firing position fully closing the gun breech and a second lower loading position uncovering the breech and having an operating lever movable between a first firing and second loading position for moving said breech block between said breech block positions, an improved autofire assembly which comprises:

a horizontal shaft rotatable between first and second positions and biased toward said second position;

stop bracket, attached to said gun for supporting said horizontal shaft with the axis of said shaft in a fixed position relative to gun during operation of said gun and for limiting downward rotation of the breech block to said second position;

a trip arm, attached to said shaft, for coming into contact with said operating lever and rotating said shaft from said second to said first position against said bias only in response to movement of said operating lever into said first firing position;

a trigger actuator attached to said shaft for rotation therewith; and a trigger, attached to said breech block, for contacting said trigger actuator when and only when said breech block is in said first upper firing position and for releasing said firing pin in response to rotation of said trigger actuator when said shaft rotates from said second to said first shaft position.

* * * * *